US006433700B1

(12) United States Patent
Malewski et al.

(10) Patent No.: US 6,433,700 B1
(45) Date of Patent: Aug. 13, 2002

(54) MULTIUSE ON/OFF SWITCH FOR HAZARD DETECTOR

(76) Inventors: Wojciech Marek Malewski, 501 N. Charlotte, Lombard, IL (US) 60148; Brian E. Schnitz, 3804 Cunningham Ave., Urbana, IL (US) 61820

( * ) Notice: Subject to any disclaimer, the term of this patent is extended or adjusted under 35 U.S.C. 154(b) by 0 days.

(21) Appl. No.: 09/784,271

(22) Filed: Feb. 15, 2001

(51) Int. Cl.[7] ..... G08B 23/00

(52) U.S. Cl. ..... 340/693.11; 340/693.9; 340/628

(58) Field of Search ..... 340/628, 629, 340/630, 693.7, 693.9, 693.11, 693.12, 506, 286.1, 632, 686.4, 693.5

(56) References Cited

U.S. PATENT DOCUMENTS 4,313,110 A 1/1982 Subulak et al. ..... 340/628
4,389,635 A 6/1983 Gallagher ..... 340/287
4,829,283 A * 5/1989 Spang et al. ..... 340/628
5,444,434 A 8/1995 Serby ..... 340/628
5,578,996 A 11/1996 Watson et al. ..... 340/628
5,682,131 A * 10/1997 Gow ..... 340/286.11
5,793,295 A 8/1998 Goldstein ..... 340/632
5,939,994 A * 8/1999 Meier et al. ..... 340/693
6,160,487 A * 12/2000 DeLuca ..... 340/693.7
6,297,745 B1 * 10/2001 Meier ..... 340/693.11

* cited by examiner

*Primary Examiner*—Van Trieu
(74) *Attorney, Agent, or Firm*—Sampson & Associates, P.C.

(57) ABSTRACT

An installation-activated, battery-powered hazard device with an on/off switch mechanism and separable into complementary portions. A first of the portions contains essentially all operative electrical circuitry, including sensor(s), a source of power, and a circuit break feature; while its complement provides various small structures or morphology that aid or facilitate closure of the break. Cooperative functioning of the structures is consistent with a stylized mating or unmating of the portions. Multiple versions of the unique multiuse or recyclable switching device are disclosed.

35 Claims, 13 Drawing Sheets

MULTIUSE ON/OFF SWITCH FOR HAZARD DETECTOR

BACKGROUND OF THE INVENTION

1. Field of the Invention

This invention relates generally to operational electric switches for wall- or ceiling mounted devices such as hazard detectors, and more particularly, to a repetitively useable on/off switch which is engaged or disengaged whenever the device/detector is installed or uninstalled, respectively.

2. Background Information

Many hazard detectors, such as fire, smoke, gas, heat, and proximity (motion) types are known and used in residential dwellings and commercial buildings. These are also termed ambient condition monitors or detectors and operate off internal and external power sources. The internal power sources are generally single or ganged batteries of practically every commercially available type, including those described generically as long-life. Although the present invention does not apply only to use of the long-life battery, its greatest utility is realized therewith, because modern production methods and economics have fostered the idea of transshipping detectors, and other battery-using devices, with the batteries installed. Indeed, in some instances, the device contains the battery power supply installed, and even hard-wired, into the operative circuitry; but, this feature can only be employed where care is taken to comply with current industrial safety and transportation laws that may not allow movement of "hot" or "active" electrical devices. Moreover, from the perspective of battery life, it is generally undesirable to have the device "hot" or "active" during shipment and while the device remains in a retailer's inventory. It is to exploit this quiescent, yet battery-installed, feature that the instant invention is provided and prior art now discussed.

In U.S. Pat. No. 5,578,996, issued for a LONG LIFE DETECTOR, there is disclosed a seemingly conventional ambient condition, surface-mountable detector which contains within its construction: a mounting bracket; a base, which contains part of a single-use, frangible, and rotatable switch mechanism, the complementary switch portion, borne on a circuit board, which is attached also to the base and secures a hard-wired, long-life battery, and a protective cover. The detector remains inactive until its installation, which requires insertion of a flat- or chisel-blade screwdriver into a slot of the switch and rotation thereof to break a frangible restraint, thus closing the switch and activating the detector. Until activation, the frangible switch impedes mounting of the detector to its bracket; the bracket serving no other function than to secure the detector (proper) to a surface. Upon reaching the end of its useful life, the detector is removed from its bracket and a screwdriver is again used to rotate the aforesaid switch to a battery "drain" position in which a second switch may be actuated to drain the battery. Thereafter the unit is discarded. This disclosure is silent regarding whether the switch is capable of retrograde motion that would allow the unit's deactivation for removal, storage and later movement to alternate locations; in the (disclosed) alternate embodiments, retrograde motion is foreclosed.

In another disclosure, U.S. Pat. No. 5,793,295, providing a DETECTION APPARATUS AND METHOD, an operational switching mechanism for a gas sensor is shown that uses a key member to house a battery package, but does not entertain a circuit-inclusive battery feature. The key, when inserted, activates the circuit irrespective of the installation status of the sensor; thus giving rise to a severe impediment to satisfying the aforesaid quiescent, battery-installed feature that is desired by the instant inventor.

An EXTENDED LIFE SMOKE DETECTOR, as disclosed in U.S. Pat. No. 5,444,434, avoids use of a physical on/off switch. The avoidance of the switch, according to the purpose stated therein, is to preclude mishaps that can occur due to improper or negligent usage. The patentee's objectives are met by constructing the device in an incipiently operative mode, providing extended long- life batteries (up to 12 years use) and avoiding the likelihood of accidental or negligent disablement, by withholding the switch/shutoff means. In the preferred embodiment, the batteries are factory-soldered into the circuitry and the external cover is permanently fixed to the (operative) detector.

Earlier hazard detectors were provided a switching that, although distinctive from the form in the instant invention, nevertheless allowed disablement of a part of their circuitry. Such a device is shown in U.S. Pat. No. 4,313,110, entitled: SMOKE ALARM HAVING TEMPORARY DISABLING FEATURES. In this application of the art, battery power is selectively applied to, or removed from, only portions of the device's circuitry, in order to temporarily silence the alarm signal. However, power continues to be furnished to the critical areas, assuring automatic alarm (enabling) should a hazard occur. An operational mode is originally acquired when the batteries are connected, irrespective of when the device is installed. In similar fashion, U.S. Pat. No. 4,389,635, for INTERFACING ATTACHMENT FOR REMOTE MECHANICAL FIRE ALARMS discloses a switch that is part of a relay system. The switch function is magnetically induced and can be inhibited by interposition of a shield (magnetic spoiler). Tripping of the (local) fire alarm, which is an essentially mechanical activity, results in driving a lever that withdraws the shield from between the switch and a proximate magnet, thus closing the switch and activating a remote alarm circuit.

Three of the previously discussed U.S. Pats. Nos. 5,578,996, no. 5,793,295 and No. 5,444,434, particularly the figures therein, are incorporated by reference for their showing of current state-of-the-art.

DEFINITIONS

The following terms shall have the indicated meanings, as may be further defined throughout this specification:

- bridge(ing)—is synonymous with short(ing) and means an electrical connection(ing) between two or more set-apart contacts or circuit portions;
- connect(able)—is synonymous with mate(able) and join (able), in all verb tenses, and means a union of two or more parts, portions or members in(to) the complete fashion or mode for which they are designed, such as, for example, providing electrical continuity between two or more contacts;
- complement—is the quantity remaining after a part or portion is removed or separated from a unit or a whole, and is both definite and discrete;
- contact(s)—is one (or more) point(s) of an electric circuit that expose a conductor;
- device—refers generally to something devised or constructed, but may be a design or pattern, depending on contextual usage;
- drive(er)—refers to an article, part, etc., or force that effects a motion or state;
- interleave—means to insert or set between a leaf, flap or tab and used herein to describe certain bayonet-type connections in apparatus;
- interrupt(ion)—is a gap in, or the act or state of breaking or opening a circuit;

separable—indicates that a whole is divisible into two or more non-operative parts;

spring-biasing—means using any resilient article to retain/return to a position; and unmate(d)(ing)—are grammatically incorrect, but will be used throughout to mean de-mate(d)(ing), because these word(s) define a single-step activity, as opposed to a two-step mate(d)(ing) activity.

All other terms of art shall have their conventional meanings or will be defined, parenthetically, with their usage.

BRIEF SUMMARY OF THE INVENTION

The instant invention overcomes deficiencies in the prior art by providing to a device, a hazard detector, an on/off switching mechanism that has a physical multiple use (multiuse) capability, i.e., it can be used, repeatedly, to activate/deactivate an electrical circuit. This on/off switch, distinctive from the types commonly used in contemporary hazard devices/sensors/detectors, is made functional only upon the mating of two or more separable portions of such a device. Until the switch is activated, the device, which contains batteries and is otherwise ready to be energized, is quiescent.

According to the invention, one (major) portion of the device or detector (hereinafter, "sensor" shall apply only to a specific element) contains essentially all the operative circuitry, power source, and sensor elements, including its protective cover. Within the circuitry an interrupt is provided consisting of a simple, single-point break embodied by two exposed, set-apart conductive points on a circuit board that contains and supports the aforesaid circuitry, power source, and sensor elements. The major portion is designed for contact and mating with its complement, the primary functions of the latter being to serve as a surface-mountable bracket and to securely retain the major portion. The mating, which is achieved by both contact and rotation (two steps) of the device's two mentioned portions, securely engages at least two mutually-borne, interleaving tabs, or captures two or more bayonet connectors, and effects simultaneous switch activation. This facility advantageously assures that the device is not electrically activated until its two major portions are mated consistent with proper installation. Another advantage of this construction is that it nominally prevents the device from being inadvertently mounted in a deactivated state once properly installed. An unmating, by counter-rotating the major portion (one step) will immediately cause the switch to open. Thus, the switch is activated only when the major portion and its complement are mated. The installed device is deactivated merely by applying a single counter rotation motion to its protective cover.

The switch mechanism includes a shorting element and is spring-biased in a position apart from the aforesaid interrupt, and a mating of the two portions of the device urges the shorting element into contact with it. In another embodiment, the interrupt is spring-biased to extend to a prospective shorting strip location that is attained by the strip only upon full mating of the aforementioned portions. In another embodiment, the switch mechanism includes a conductive key. The device is activated only upon inserting the key fully into the device, thereby electrically connecting two or more contact springs.

DETAILED DESCRIPTION OF THE INVENTION

Throughout this description, many detector elements known in the art may not be shown, itemized or discussed. For this reason, and after detailed disclosure of various embodiments, only variations (versions) of the invention switch mechanism will be highlighted.

Figure 1:
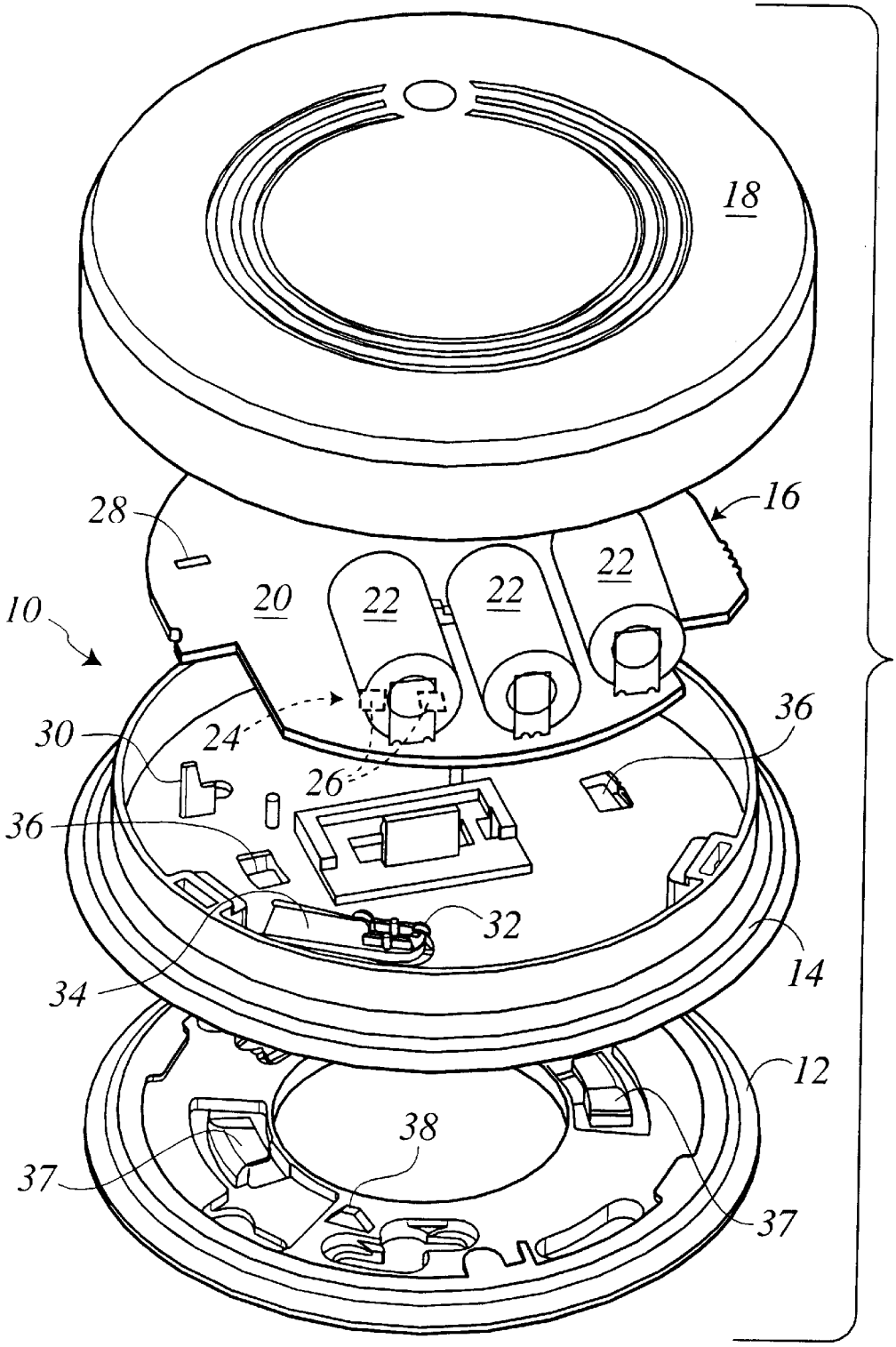
FIG. 1 is an exploded perspective view, taken from above, of a hazard device including the invention in a first embodiment.

Having reference to the drawings, there is shown in FIG. 1 a hazard detector 10, typical of the type for which the invention is designed and including a mounting bracket 12, a base 14, an essentially electronics/power/sensor (EPS) section 16 and a protective cover 18. The EPS section 16, for the purpose of this disclosure, contains fundamentally all of the necessary circuitry (not shown) that would be typical of the particular hazard detector. This circuitry is disposed in a circuit board 20, which also is adapted to secure batteries 22 thereto. An interrupt 24 is provided in the circuitry as a single-point break in continuity and defined, in an exemplary embodiment, by electrically conductive points, referred to herein as contact pads 26. Contact pads 26 are exposed on the underside of board 20 and, although not necessary (as will be discussed later), in close proximity to each other. Board 20 is fashioned for capture in base 14 and may be guided by insertion of a standoff 30 into a guide hole 28 (additional guiding elements not shown) so that the interrupt is directly over shorting element 32 held in base 14.

Base 14 features a "living" hinge 34, on which a shorting element 32 is disposed. Hinge 34 is, in its simplest form, a flap portion of the base which, when deflected from its "idle" coplanar posture in the base, and not constrained in some manner, will be rebiased to that posture, in a spring-like manner (spring-biasing). Remaining aspects of base 14 include two downwardly-depending leaves or tabs 36 that may be set diametrically apart from each other. Tabs 36 may be designed to interleave with, and mutually capture, their upwardly-oriented, like tabs 37 of bracket 12, thus effecting a mating of base 14 and bracket 12 after CW rotation of one with respect to the other. Final to this figure, and unique to this version, are two ramp-like detents 38 that may be disposed on bracket 12, 180 degrees apart in top view projecting upwardly from a position that, upon the aforesaid mating and not before, will push the tip of hinge 34 upward and force shorting element 32 to bridge the gap between (contact) pads 26 of interrupt 24. Thus, when base 14 is aligned with and guided into bracket 12, and mated so as to interleave tab pairs 36,37, the two portions (EPS-base and its bracket) complete the operative unit.

Figure 2:
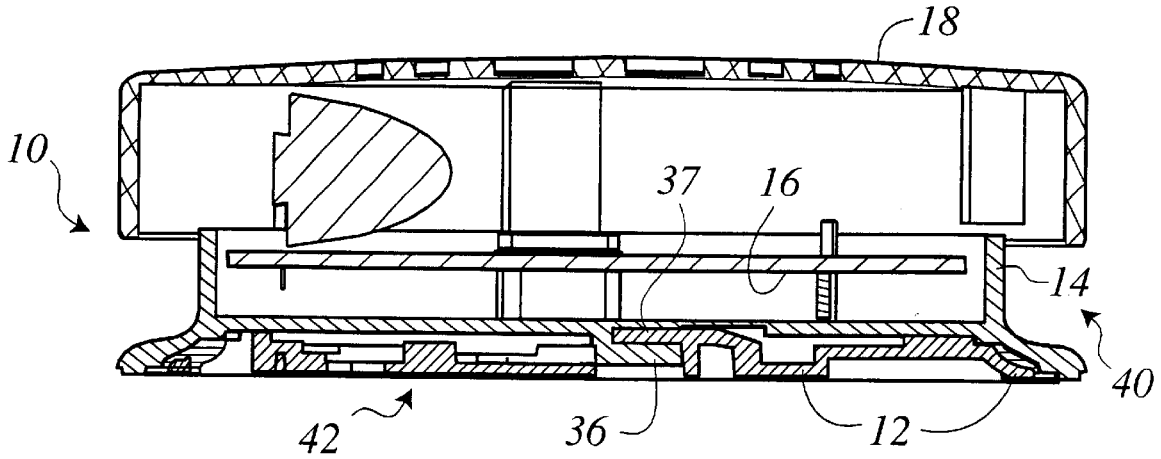
FIG. 2 is a sectional elevation of the FIG. 1 device illustrating a mating apparatus between two portions thereof, the covered base and the mounting bracket.

For the most part, FIG. 2, like FIG. 1, depicts structure that is common to three disclosed embodiments of the invention; it is presented to illustrate the mated condition of two portions of a detector that features the instant invention. These two portions of detector 10 include: the EPS-base 40, containing the fixed circuit board 16, installed in base 14, with its projecting tab(s) 36; and the mating complement 42, including bracket 12 with its like tab(s) 37. In the mated condition, tab 37 is bayonet-fitted into the position indicated, which depending upon the actual mode of manufacture, may be interleaved. The remaining figures deal with the remaining versions of the invention, which are said to be generic, in that all prescribe a form of interrupt(ion) to an otherwise power-enabled circuit and a shorting element that is urged into bridging the interrupt, to activate the host device.

Figure 3:
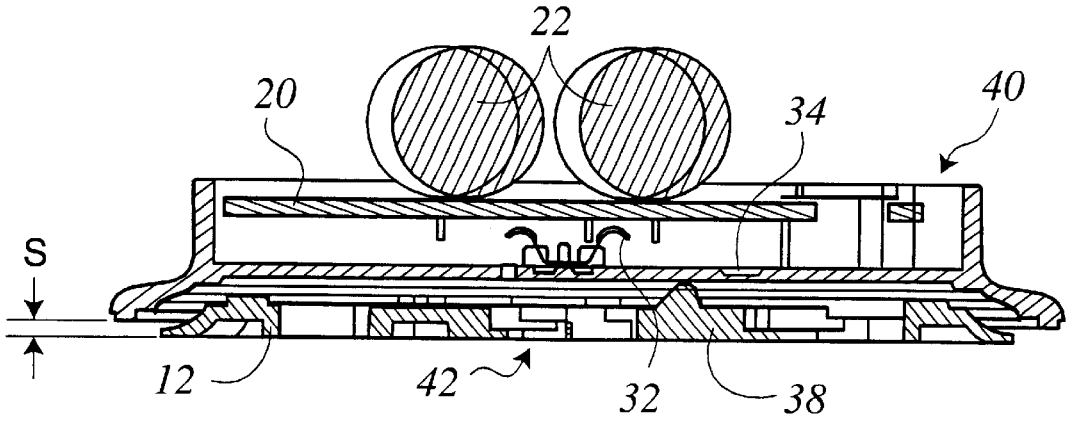
FIG. 3 is a sectional elevation of the FIG. 1 device showing the invention, in a first embodiment, immediately prior to its activation.
Figure 4:
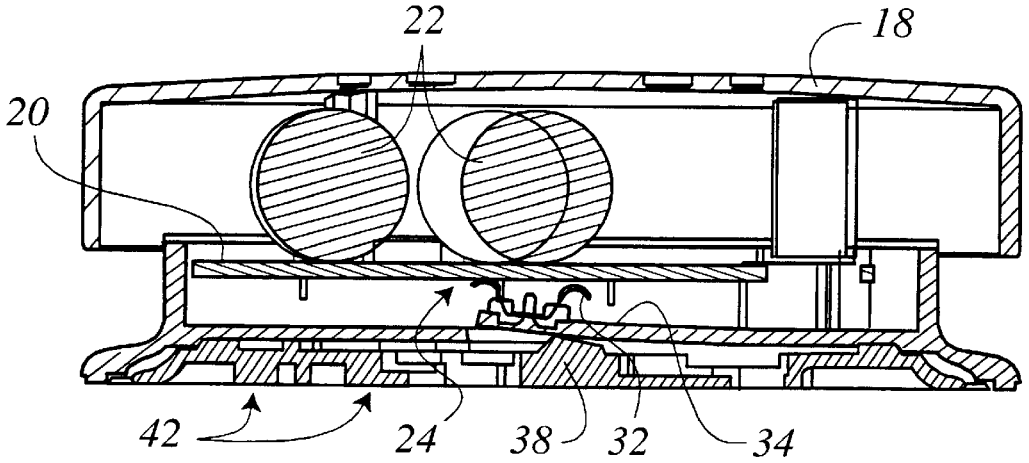
FIG. 4 is the FIG. 3 illustration showing the invention activated.

FIG. 3 shows, in sectional elevation, EPS-base 40 portion poised over complement 42. The tip of hinge 34 bears thereon shorting element 32 which is below the board, but offset from interrupt 24 (not visible) because, as indicated by the separation S, the portions have not yet been mated by the action of contact-and-rotation, as previously described. In FIG. 4, mating has been accomplished and detent 38 has been rotated under, and has contacted the tip of hinge 34, urging shorting element 32 thereon into contact with board 16-postured interrupt 24 (not visible, but coarsely illustrated in phantom), on the underside of circuit board 20 (see FIG. 1). As shown, continuity is restored to the circuit and the device is active electrically. When portions 40,42 are unmated, by a mere rotation counter to that of the installation mating, detent 38 is moved away from the tip of hinge 34 and it relaxes, or is spring-like rebiased to its idle (non deflective) normative posture, and the circuit is broken.

Figure 5:
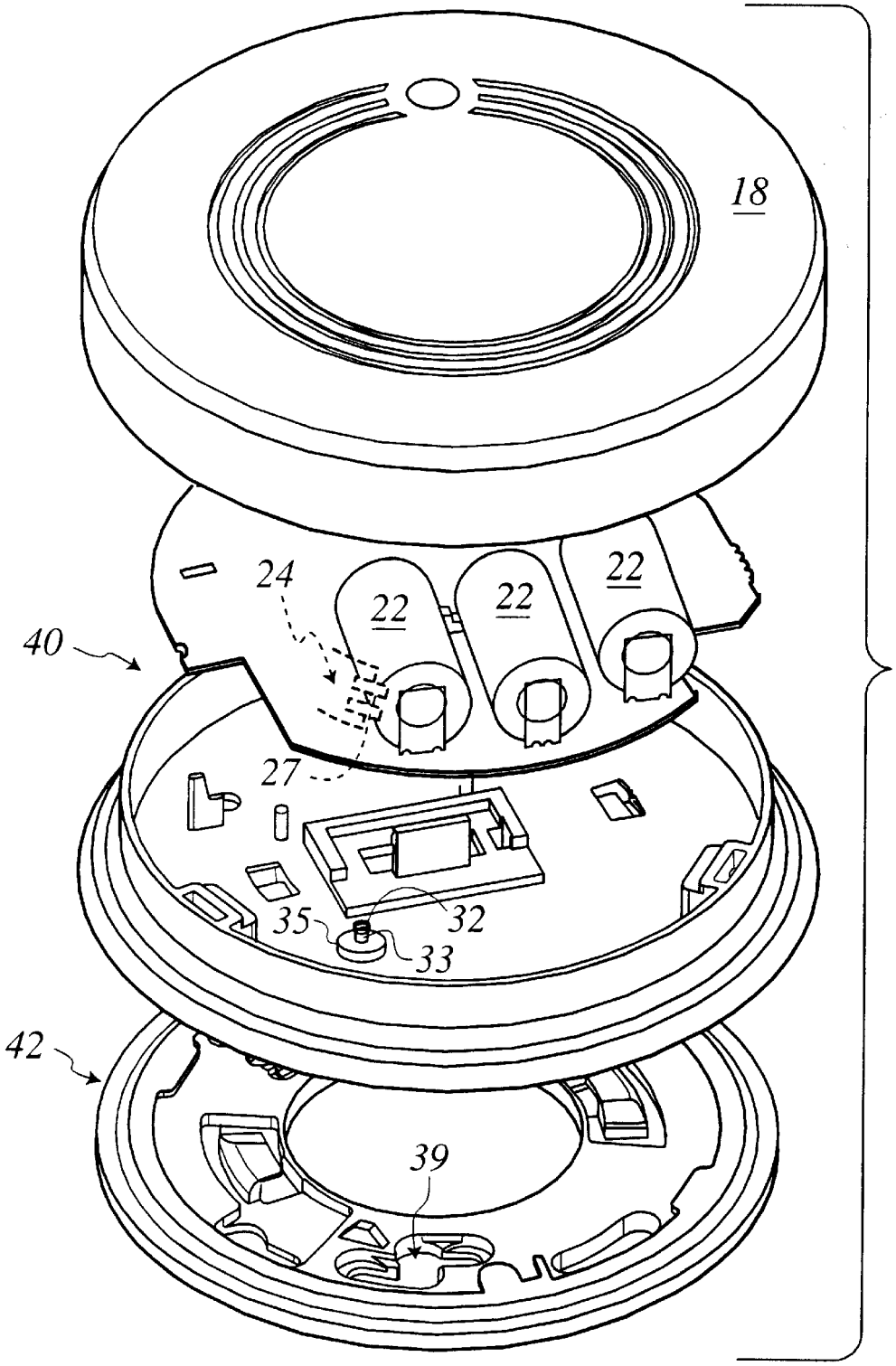
FIG. 5 is an exploded perspective view, taken from above, of a hazard device containing the invention in a second embodiment.
Figure 6:
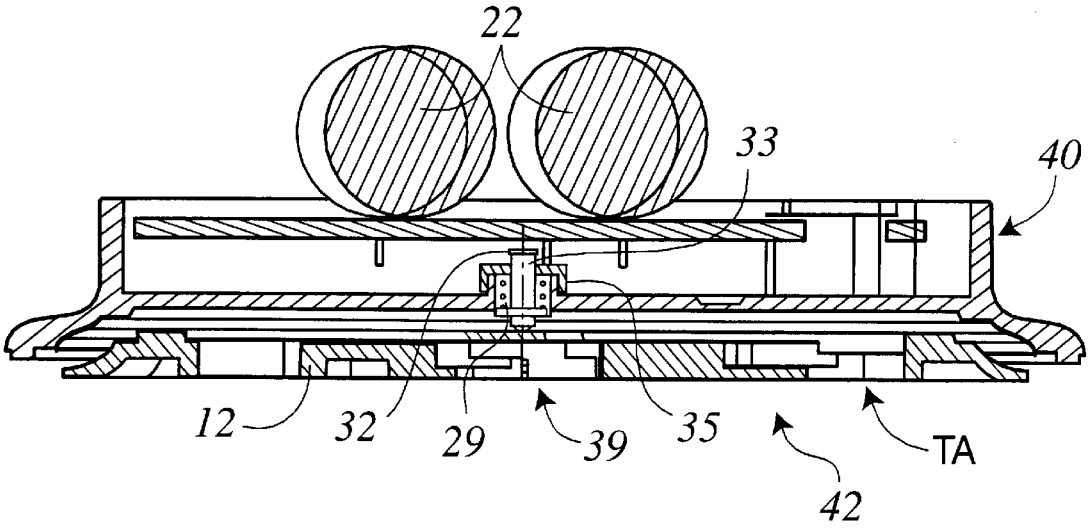
FIG. 6 is a sectional elevation of the FIG. 5 device, without cover, showing the second embodiment, immediately prior to its activation.
Figure 7:
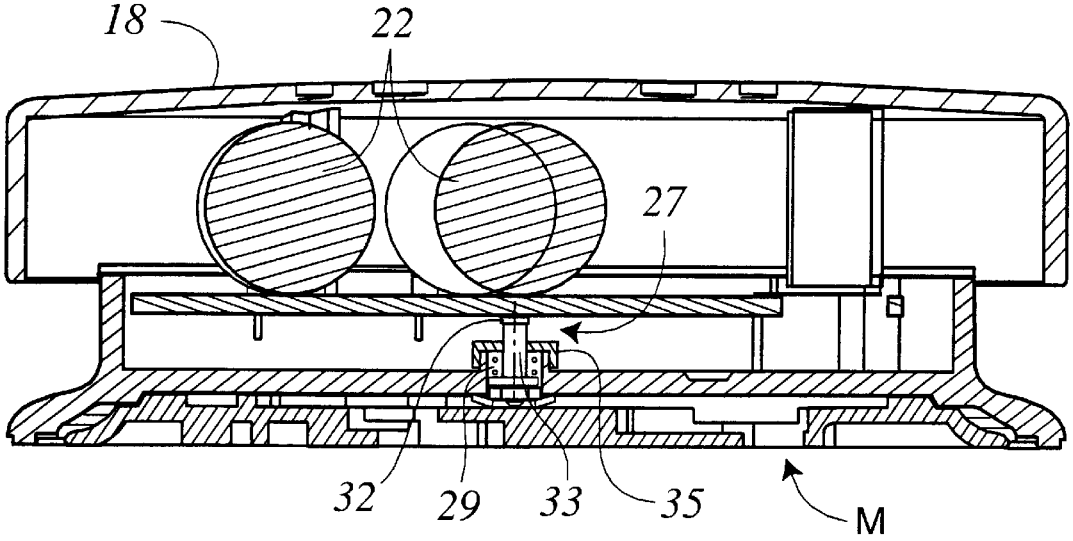
FIG. 7 is the FIG. 6 illustration, with cover, showing the invention activated.

A second embodiment maybe realized using the first mating activation mode or by physically altering the shorting element mount and avoiding the detent member altogether. FIGS. 5–7 exemplify this version. Interrupt 24, although shaped differently when compared to the embodiment discussed hereinabove, and using a closer pad array 27, is substantially identical electrically to the first embodiment. This distinction in (version(s) of) the invention lies specifically in the details for shorting/bridging interrupt 24, which in this embodiment is accomplished using the shorting element 32, the spring loaded shaft 33 held in capsule 35, and the detent-effecting action of aperture 39. This embodiment derives from the production mode requirements of the fabricator, whether to make a very short shaft (not shown) and detent 38 arrangement, as shown in FIGS. 1, 3, and 4, or the alternate shown in FIGS. 5–7. In either case, it is a surface, or part of bracket 12 that invariably urges a bridge-carrying member towards the interrupt, but only upon mating of portions 40 and 42. This distinction is readily appreciated by reference to FIGS. 6 and 7, which depict a device that is otherwise substantially the same, in most details and operation as FIGS. 3 and 4. The interrupt is not shown but, as it appeared in FIG. 5, it is placed permanently over the shaft 33-borne shorting element 32. A capsule 35 contains shaft 33, which is positioned and spring 29-biased in a lowered/idle (with respect to interrupt pad array 727) state. FIG. 6 specifically details the installation pre-mating setup: portion 40 is placed over portion 42; the tabs are in alignment TA; and, shorting element 32 is away from the interrupt. In the mated state M of FIG. 7, after the portions have been pressed together and rotated, the bayonet-connection tabs are interleaved and the shaft 33, having ridden "up" onto a surface of the bracket 12, has urged the shorting member 32 into bridging contact with the interrupt pads 27. Reversal of this rotation step repositions shaft 33 and spring 29 will re-bias it to the lowered, idle posture.

Figure 8:
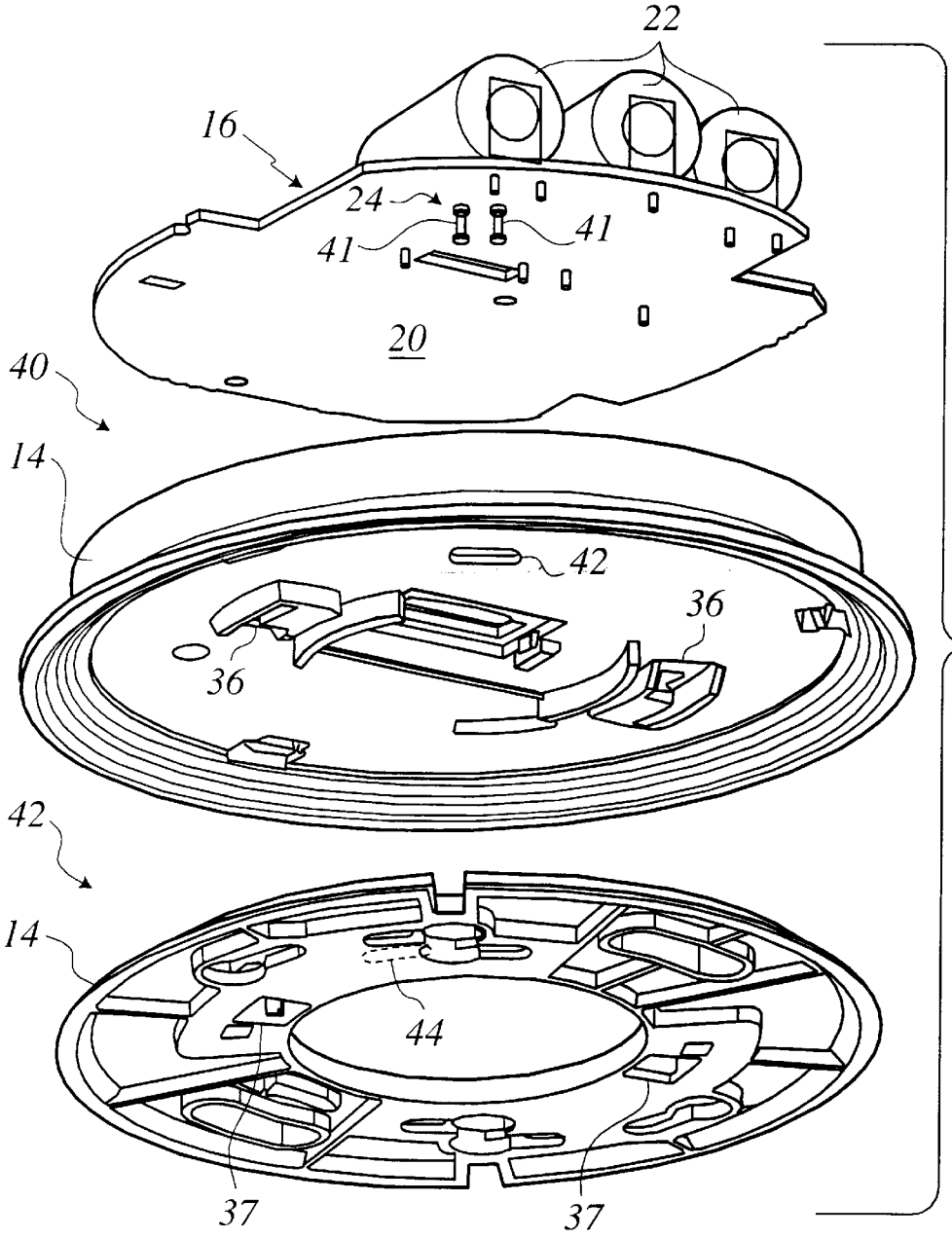
FIG. 8 is an exploded perspective view, taken from below, of three component sections of a hazard device and in which a third embodiment of the invention is illustrated.
Figure 9:
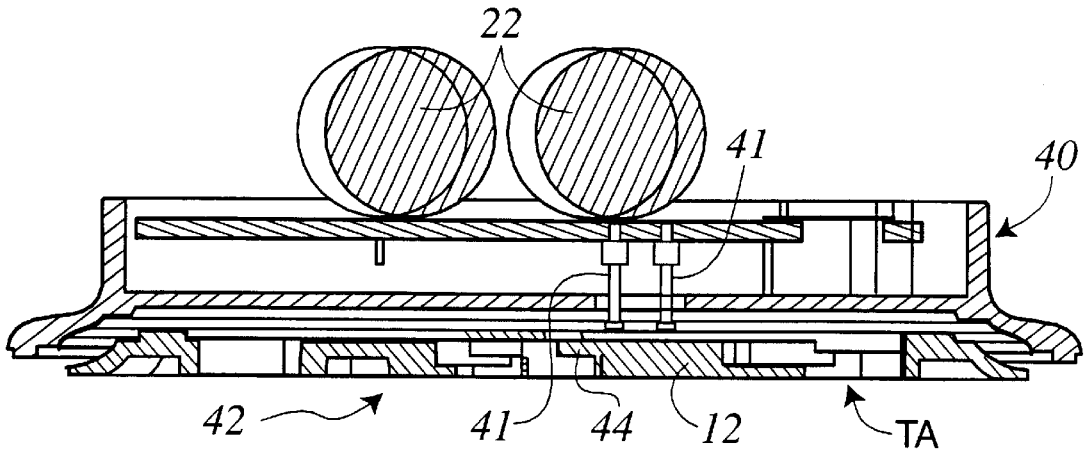
FIG. 9 is a sectional elevation of the FIG. 8 device to showing the third embodiment, immediately prior to its activation.
Figure 10:
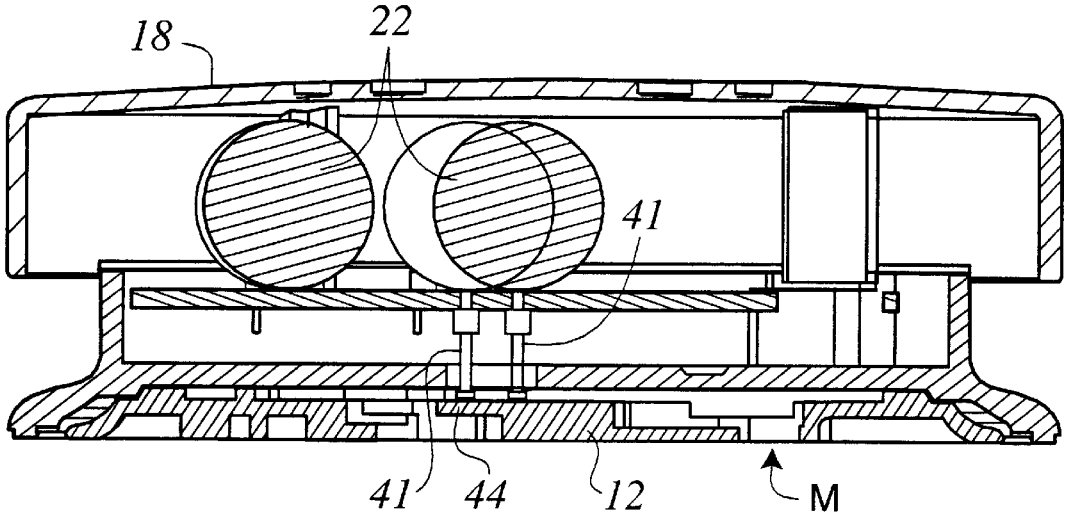
FIG. 10 is the FIG. 9 illustration, with cover, showing the invention activated.

In a third embodiment of the switch, shown in FIGS. 8–10, only the physical details of the switch and the interrupt change, but the electrical function remains nominally the same in response to the mating process and counter-rotating step. FIG. 8, showing various components of the device, portrays EPS section 16 subtending a pair of set-apart, downwardly spring-biased pins 41 that are below-the-board extensions of interrupt 24 contacts (not shown) and which correspond electrically to the circuit break of the first and second embodiment. Base 14 has normal bayonet-connection tab 36 setup and a slot 42, which allows passage of the pins through to it. Bracket 12 has the complementary bayonet-connection tab 37 arrangement and a conductive strip 44 on its upper surface. This strip is of a shape and a position such that alignment of portions 40,42 and their contact will allow, at most, only one of pins 41 to contact strip 44, thus the break in the circuit is maintained. FIG. 9 shows the tab alignment TA and pins 41 in fully extended position. Conductive strip 44 is offset and is not in contact with pins 41. Reference to FIG. 10 discloses portions 40,42 mated M and both pins contacting the shorting strip to effect a closed circuit. Counter-rotation of one of the portions will break the circuit, as in the first and second versions. Those of ordinary skill will realize that the spring-biased pins may be of different design, e.g., including downwardly directed, conductive leaves or tabs.

Figure 11:
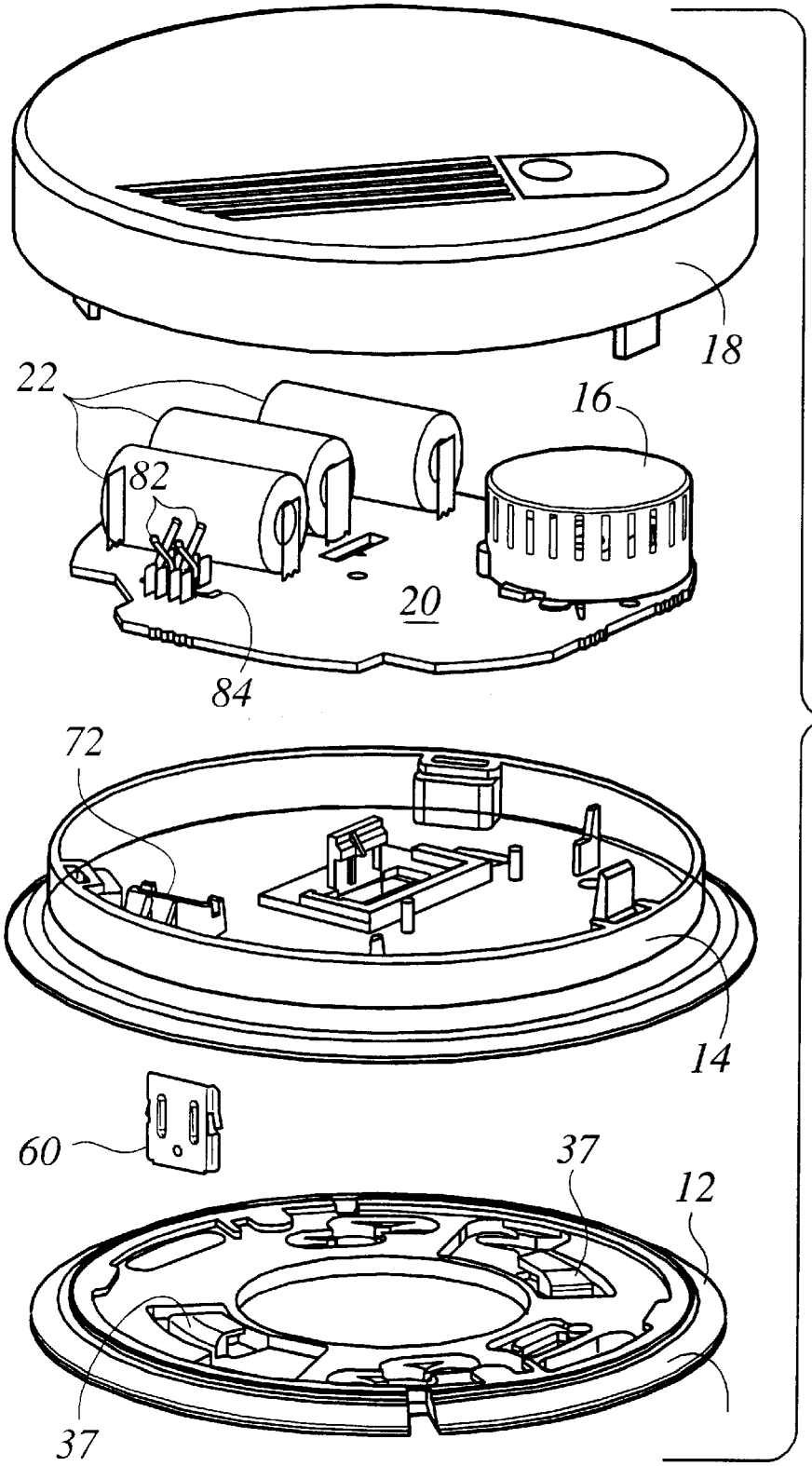
FIG. 11 is an exploded perspective view, taken from above, of a hazard device including the invention in a fourth embodiment.

A fourth embodiment, shown in FIGS. 11–20, is similar to the three previous embodiments in that it includes mounting bracket 12, base 14, EPS section 16, protective cover 18 and a switch that is used to activate the device (i.e. make a connection with electrical power). This embodiment also differs from those described above. FIG. 11 shows activation key 60 (discussed in greater detail hereinbelow) and four spring contacts 82 mounted directly on printed circuit board 20. For pictorial clarity and for the purpose of highlighting the functionality of the switch, printed circuit board 20 does not show most components which are not associated with the switch.

Figure 12:
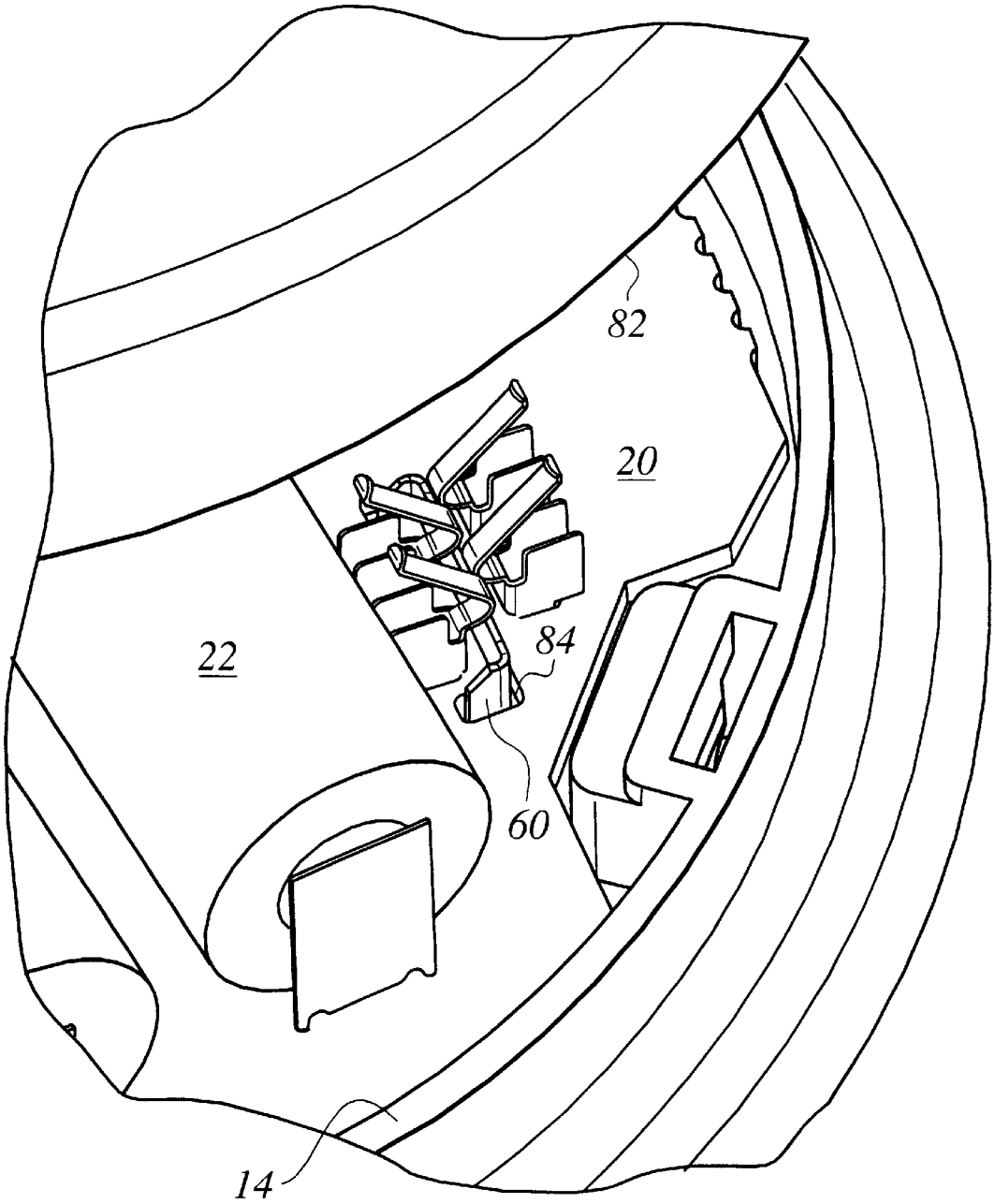
FIG. 12 is an expanded view showing one possible arrangement of the contact springs on the circuit board.

Printed circuit board 20 includes, among other electronic components, one or more (at least two is preferable) pairs of spring contacts 82 linked in parallel so that when at least one pair is bridged by activation key 60 (i.e. electrically closed or shorted), the device (hazard detector 10) is activated. Multiple spring contacts 82 may be soldered directly to circuit board 20, and are superposed with a slot 84 in circuit board 20. Slot 84 is shaped approximately the same as the cross sectional shape of a conductive member (i.e., key 60) that may be inserted through slot 84 from the bottom side of board 20 to activate the device. Each pair of spring contacts 82 may include one contact disposed on one side of slot 84 and another contact on the opposite side of slot 84. As mentioned hereinabove, utilization of multiple pairs linked electrically in parallel with one another, is preferred to improve reliability of the device. An enlarged view of spring contacts 82, arranged in a staggered pattern, is shown in FIG. 12. Staggered contacts 82 both enable adjustment of the force required to insert activation key 60 between the contacts and to simplify the process of soldering spring contacts 82 to circuit board 20.

Figure 13:
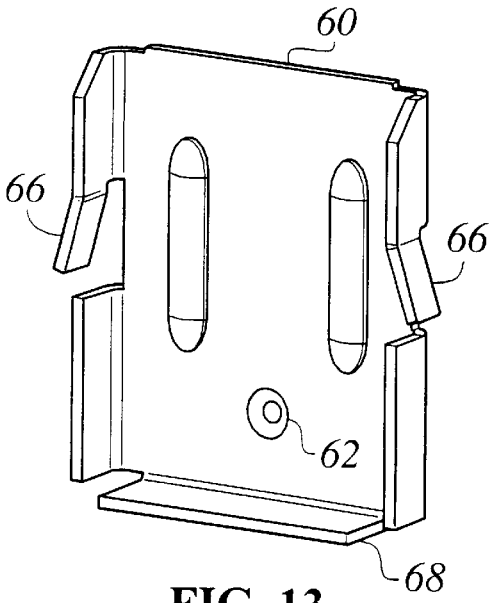
FIG. 13 is a perspective view of the activation key shown in FIG. 11.
Figure 14:
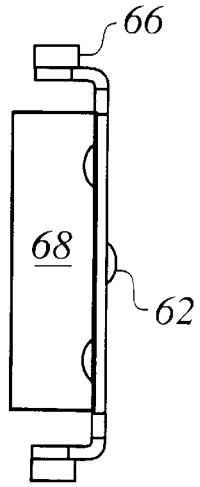
FIG. 14 is a top view of the activation key of FIG. 13.
Figure 15:
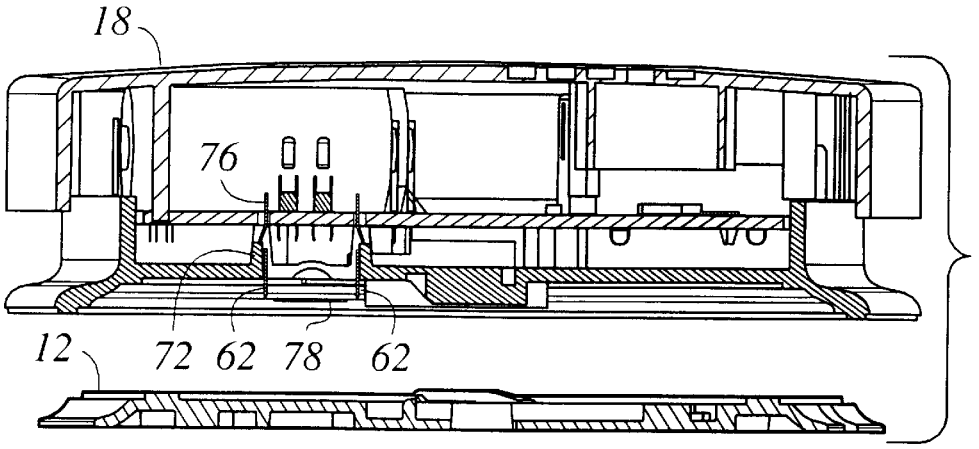
FIG. 15 is a sectional elevation showing the engagement of activation key locking tabs in the fourth embodiment of this invention.

Activation key 60, which is shown in more detail in FIGS. 13–14, is made of, or coated with, a conductive material. A spring tempered brass or other metal is preferred. During production, once the hazard detector of this embodiment has been substantially fully assembled (snapped together) the loose (i.e. not attached to anything) activation key 60 is inserted into activator slot in base 14 from the side opposite to circuit board 20 (as shown in FIG. 11). Activation key 60 is to be inserted fully, i.e., until its horizontal bottom ledge 68 is flush with the bottom surface of base 14, for electrical testing of the device. Activation key 60 is then pulled away (i.e. retracted) from the board, its undesirable complete removal from the device being prevented by means of the two locking tabs 66 which, upon pulling key 60 away from base 14, make barb or fluke-like contact with the upper surface of an activation key guide 72 (FIGS. 11 & 15) molded or otherwise disposed on base 14 (see FIG. 15). Aforementioned locking tabs 66 prevent accidental removal or separation of activation key 60 from the device, thus eliminating the possibility of its being lost.

Figure 16:
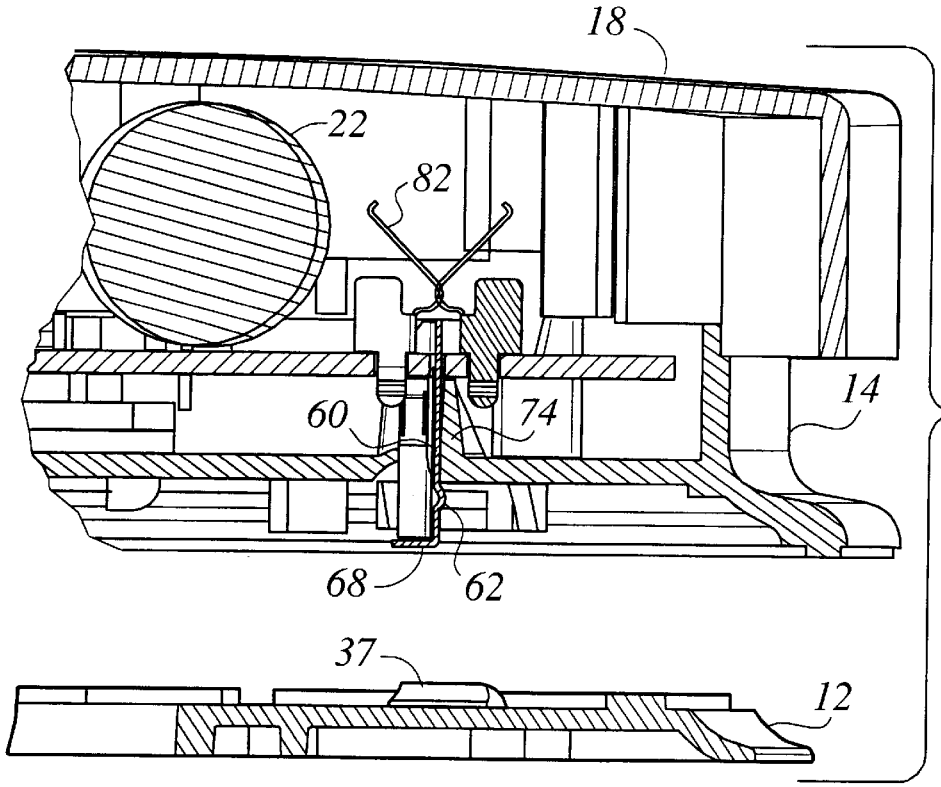
FIG. 16 is an expanded sectional elevation showing the activation key of the fourth embodiment in the off (deactivated) position.

FIGS. 13, 14, and 16 show a single dimple 62 on the centerline of activation key 60. The role of dimple 62 is to provide a sudden surge of resistance when pushing key 60 into base 14. When in the process of inserting key 60, the first onset of resistance indicates that locking tabs 66 are partially deflected, and that key 60 is still in the off position. Pushing key 60 further, beyond the off position, requires higher force owing to friction between activator dimple 62 and the corresponding base guide wall 74, wedging the leading edge of key 60 between spring contacts 82 in order to deflect them for making a reliable electrical connection, and deflection of key 60 in the dimple area when dimple 62 is depressed by guide wall 74 (FIGS. 16 and 17).

Turning back to FIG. 16, the device is shown with key 60 in the off position. As shown, key 60 is not in contact with spring contacts 82 and dimple 62 is not yet in contact with guide wall 74. A feature of this embodiment is that it provides a safeguard against installing the device without activating it. When key 20 is in the off position, bottom ledge 68 protrudes from base 14, where it interferes with making the bayonet-type connection between base 14 and mounting bracket 12. Only when key 20 is pushed in all the way (i.e. to the ON position), as shown in FIG. 17, may one attach the device to mounting bracket 12, as shown in FIG. 18.

Figure 17:
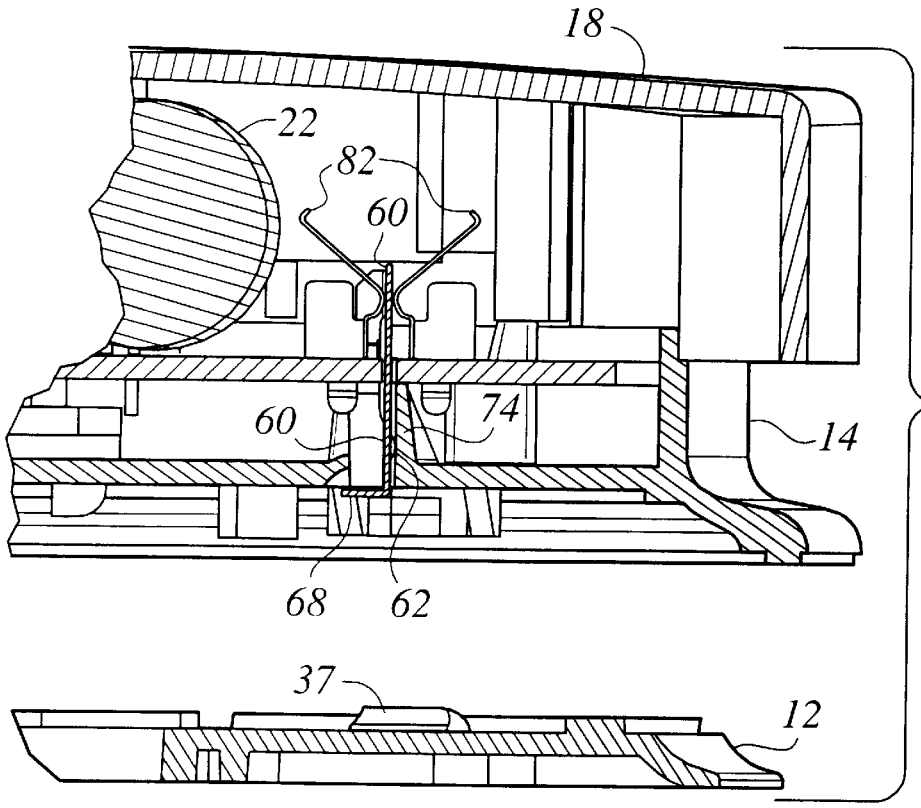
FIG. 17 is an expanded sectional elevation showing the activation key of the fourth embodiment in the on (activated) position.
Figure 18:
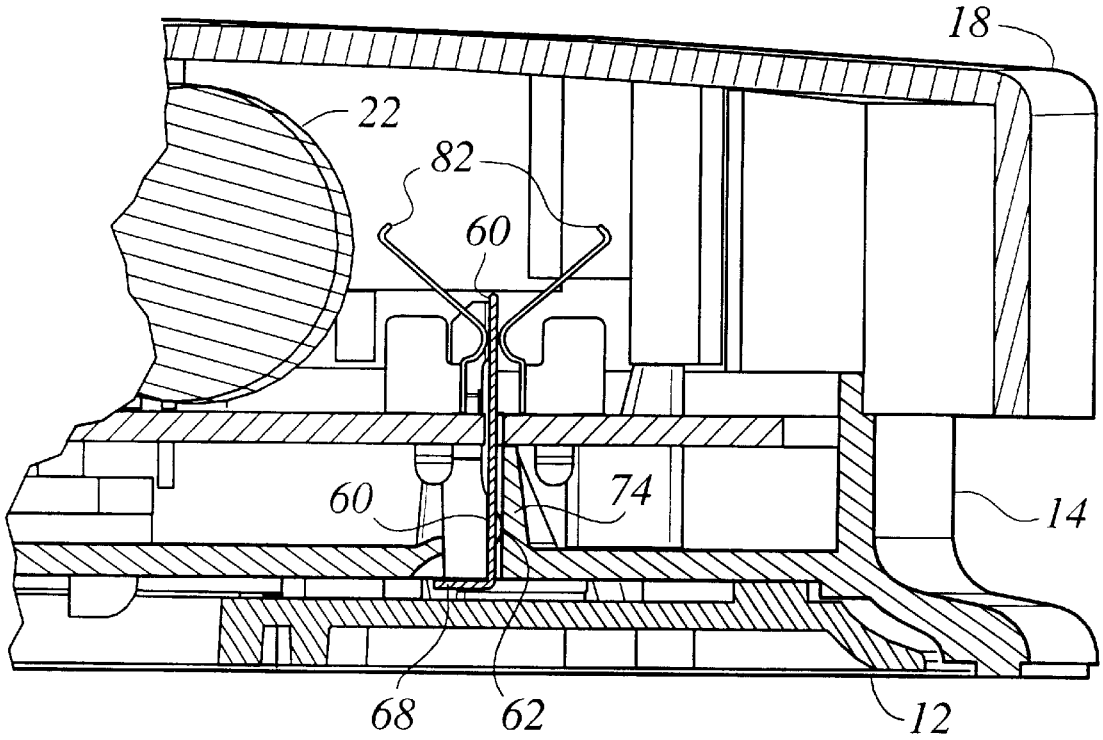
FIG. 18 is an expanded sectional elevation showing the activation key of fourth embodiment in the on (activated) position and showing the device fully mounted to the mounting bracket.

FIGS. 17–18 are cross sectional views of the device with key 60 in the ON position. Key 60, as shown, resides among, in electrical contact with, spring contacts 82. Further, dimple 62 is wedged into guide wall 74 resulting in a slightly "off-plumb" orientation of the main body of key 60.

Owing to the force required to insert activation key 60 into contact springs 82 (which are located on circuit board 20), it may be desirable to modify the means by which circuit board 20 is mounted into base 14. For example, it may be desired to rigidly affix circuit board 20 to base 14 near slot 84 to prevent deflection of circuit board 20 during insertion of key 60. Optionally, protective cover 18 may be fitted with one or more ribs (not shown) that extend to the upper surface of circuit board 20 when protective cover 18 is snapped into place. The purpose of such ribs is to hold circuit board 20 down securely in place, such that it is not deflected by the force required to insert activation key 60.

Figure 19:
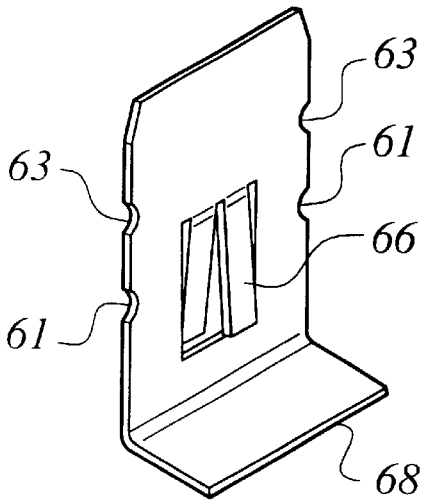
FIG. 19 is an perspective view of an optional activation key for a variation of the fourth embodiment.
Figure 20:
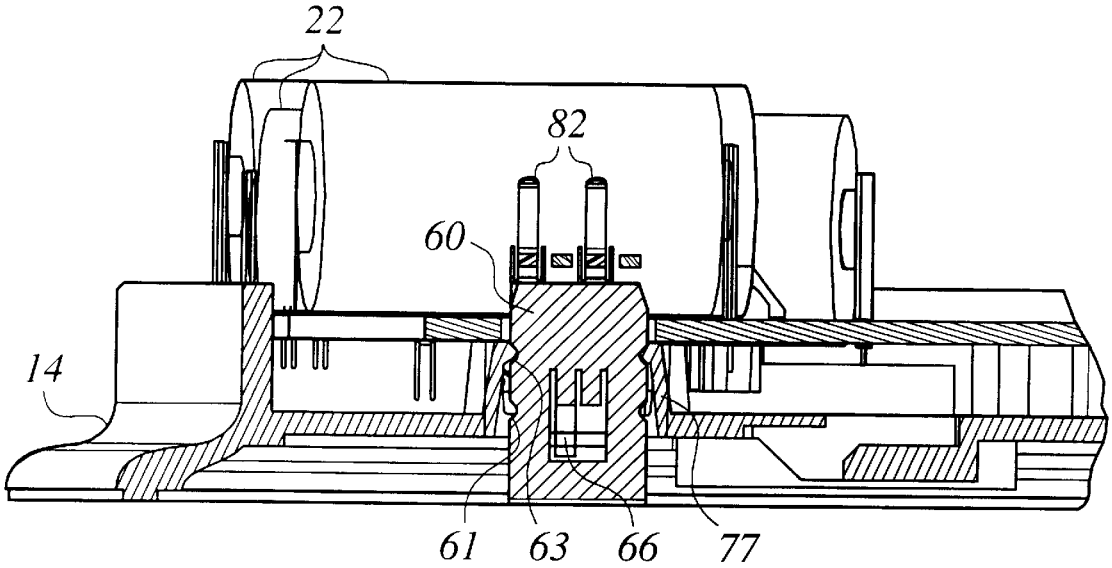
FIG. 20 is an expanded sectional view showing the activation key of FIG. 19 in the off position.

Activation key 60 may have a different shape than that disclosed above. For example, FIG. 19 shows one of many optional keys 60' shaped for a corresponding base that may guide this key 60' through a slotted circuit board 20 into contact with one or more pairs of spring contacts 82. Two notches 61, 63 on each side of activation key 60' provide two distinctive positions for the inserted key; the two upper notches 63 corresponding to the OFF position and the two lower notches 61 corresponding to the ON position when the activator is mated with two molded-in snaps 77 (FIG. 20) in base 14. FIG. 20 shows the activation key 60' of FIG. 19 inserted into the device in the OFF position. Activation key 60 may further include one or more (two shown) locking tabs 66'.

One of ordinary skill in the art will recognized that numerous other key shapes may be utilized in the present embodiment. For example, a round (solid or tubular) key with slots, such as those shown in FIG. 19, or snaps may be used. The activation key in front view may also resemble an uppercase letter T, with two tab protrusions (see FIG. 19) limiting the key's travel when pulling it out. Also, instead of pushing an activator in, one can envision screwing in or twisting in a round activation key into two or three flat cross section leaf springs spaced 180 or 120 degrees apart as seen in a view normal to the PCB surface. The above described bridging mechanism and optional variations thereof involve pushing in or screwing in a conductive activator between two or more spring contacts in order to close the circuit to the hazard detector. One may further conceive of a non-conductive activator that is V-shaped, U-shaped, channel or cap shaped that can be pushed onto two or more spring contacts in order to force them together, thereby closing the electrical circuit.

The embodiment described hereinabove is for a hazard detector wherein circuit board 20 has copper lamination for electronics on only one side (primarily for cost constraints). Modifications to activator key 60 or other components of the invention to accommodate a double-sided circuit board are well within the scope of this invention.

All of the disclosed versions of the invention embrace similar concepts of design and, in structure, are fundamentally the same, namely: an open-circuited, but otherwise operative electronic device, is maintained inactive under non-operational conditions such as transportation, storage, point-of-sale display, etc. Full activity of the device is acquired upon its mating with its complementary portion, which effects and/or requires a closing of the open circuit. The nuance of a shorting strip or element fixed to a driven support may be avoided by simply substituting a conductive support; but such minor modifications may be made without departing from the spirit of the invention.

What is claimed is:

1. A battery-powered hazard detector comprising:

at least two separable portions, one of which has electrical circuitry and a source of power;

an electrical interrupt within said electrical circuitry that provides at least one single-point break therein;

a movable shorting element alternately actuatable between a first position closing said break, and a second position opening said break, respectively, said shorting element being actuatable in tandem with a mating and unmating of said two separable portions, wherein said shorting element is actuatable into said first position while said two separable portions are mated, and actuatable into said second position only while said two separable portions are unmated; and wherein said mating is prevented when said shorting element is disposed in said second position.

2. The hazard detector of claim 1 wherein said interrupt comprises at least two set-apart and exposed points in said electrical circuitry that are adapted to support conductive pads.

3. The hazard detector of claim 2 wherein said moveable shorting element is spring-biased.

4. The hazard detector of claim 2 wherein said movable shorting element is a conductive strip disposed on a surface of one of said portions.

5. The hazard detector of claim 1 wherein said moveable shorting element is an activation key, said activation key being a conductive and retractable member sized and shaped for being alternately positioned into and out of said break.

6. The hazard detector of claim 5 wherein said activation key comprises at least one locking tab to capture the activation key within the detector.

7. The hazard detector of claim 5 wherein said activation key is C-shaped in cross section taken perpendicular to the push-in direction.

8. The hazard detector of claim 5 wherein said electrical interrupt comprises at least one pair of spring contacts.

9. The hazard detector of claim 8 wherein each of said pair of spring contacts includes one spring contact disposed on one side of a slot in one of two said separable portions and one spring contact disposed on another side of said slot.

10. The hazard detector of claim 9 wherein said interrupt comprises two pairs of spring contacts arranged in a staggered pattern.

11. The hazard detector of claim 5 wherein said activation key is activated in a direction substantially orthogonal to a plane defined by said two separable portions and substantially parallel to a mating direction of said two separable portions.

12. The hazard detector of claim 1 further comprising a driver to motivate said movable member.

13. A battery-powered hazard detector comprising:

at least two separable portions of which one of said two separable portions includes electrical circuitry and a source of power;

an electrical interrupt, within said electrical circuitry, that provides at least one single-point break therein, said electrical interrupt including at least one pair of spring contacts including one spring contact disposed on one side of a slot in one of two said separable portions and one spring contact disposed on another side of said slot;

an activation key, said activation key being a conductive and retractable member sized and shaped for being alternately actuated between first and second positions, establishing and disestablishing continuity between said contacts, respectively;

said activation key being actuated in a direction substantially orthogonal to a plane defined by said two separable portions and substantially parallel to a mating direction of said two separable portions; and wherein mating of said separable portions is prevented when said activation key is disposed in said second position.

14. A multiuse switch for a battery-operated hazard detector, the detector including two separable portions with one of said separable portions having electrical circuitry disposed therein, the multiuse switch comprising:

a battery power source in communication with the electrical circuitry and disposed in one of said two separable portions;

an interrupt included within the electrical circuitry, for effecting at least a single-point break in continuity thereof;

a movable shorting device for alternately closing or reopening said break in continuity, said shorting device being selectively actuatable in tandem with a mating or unmating of said two separable portions, wherein said shorting device closes the break in continuity while said two separable portions are mated and opens the break in continuity only while said two separable portions are unmated; and wherein said mating is prevented when said shorting device is disposed to disestablish the electrical contact.

15. The switch of claim 14 wherein said interrupt comprises at least two set-apart and exposed points in said circuitry, said points adapted to support conductive pads.

16. The switch of claim 15 wherein the moveable shorting device comprises a spring-biased support bearing thereon a shorting element.

17. The switch of claim 15 wherein the moveable shorting device comprises a shorting strip permanently disposed on one of said portions.

18. The switch of claim 14 wherein said moveable shorting device is an activation key, said activation key being a conductive and retractable member sized and shaped for being positioned into and out of said break in continuity, establishing and disestablishing said contact, respectively.

19. The switch of claim 18 wherein said activation key comprises at least one locking tab.

20. The switch of claim 18 wherein said interrupt comprises at least one pair of spring contacts.

21. The switch of claim 20 wherein each of said pair of spring contacts includes one spring contact disposed on one side of a slot in one of said two separable portions and one spring contact disposed on another side of said slot.

22. The switch of claim 21 wherein said interrupt comprises two pairs of spring contacts arranged in a staggered pattern.

23. The switch of claim 18 wherein said activation key is activated in a direction substantially orthogonal to a plane defined by said two separable portions and substantially parallel to a mating direction of said two separable portions.

24. The switch of claim 14 further comprising driving means for urging movement of said shorting device.

25. A method of effecting, alternately, operative-inoperative states in a hazard detector upon installation-removal thereof, said method comprising:

(a) providing a hazard detector having at least two joinable portions, one of the portions including electrical circuitry and a source of power;

(b) establishing a physical break in said circuitry, including a gap disposed between at least two set-apart contacts; and (c) moving a shorting member alternately into and out of a bridging orientation with said contacts, in tandem with alternately mating and unmating the two separable portions, wherein the shorting member is adapted to establish the electrical contact while the two separable portions are mated and to disestablish the electrical contact only while the separable portions are unmated, wherein said mating is prevented when said shorting member is disposed out of the bridging orientation with said contacts.

26. The method of claim 25 wherein said mating comprises a coaxial contacting and clockwise coaxial rotating of said portions.

27. The method of claim 26 wherein said unmating comprises only counter-rotating said portions.

28. The method of claim 26 wherein said shorting member is an activation key, said activation key being a conductive and retractable member sized and shaped for being positioned into and out of said break, establishing and disestablishing said contact, respectively.

29. The method of claim 28 wherein said contacts are one or more pair of contact springs.

30. The method of claim 29 wherein said moving (c) comprises alternately pushing the activation key into contact with said contact springs and pulling the activation key out of contact with said contact springs, respectively.

31. A hazard detector comprising:

at least two separable portions, one of which has electrical circuitry and a source of power;

an electrical interrupt within said electrical circuitry that provides at least one single-point break therein; and an movable shorting element alternately actuatable between a first position closing said break, and a second position opening said break, respectively, said movable shorting element being actuatable in tandem with a mating and umnating of said two separable portions, wherein said movable shorting element is actuatable into said first position while said two separable portions are mated, and actuatable into said second position only while said two separable portions are unmated; and said movable shorting element being actuatable in a direction substantially orthogonal to a plane defined by said two separable portions and substantially parallel to a mating direction of said two separable portions.

32. A hazard detector comprising:

at least two separable portions, one of which has electrical circuitry and a source of power;

an electrical interrupt within said electrical circuitry that provides at least one single-point break therein;

a movable shorting element alternately actuatable between a first position closing said break, and a second position opening said break, respectively, said shorting element being actuatable in tandem with a mating and unmating of said two separable portions, wherein said shorting element is actuatable into said first position while said two separable portions are mated, and actuatable into said second position only while said two separable portions are unmated; and wherein said mating is prevented when said shorting element is disposed in said second position.

33. A hazard detector comprising:

at least two separable portions, one of which includes electrical circuitry and a source of power;

an electrical interrupt within said electrical circuitry that provides at lest one single-point break therein; and a movable shorting element alternately actuatable between a first position closing said break, and a second position opening said break, respectively, said shorting element being actuatable in tandem with a mating and unmating of said two separable portions, wherein said shorting element is actuatable into said first position while said two separable portions are mated, and actuatable into said second position only while said two separable portions are unmated;

said shorting element being actuatable in a direction substantially orthogonal to a plane defined by said separable portions;

wherein said movable shorting element is disposed on one end of a cantilever hinge;

wherein during said mating a detent is rotated under said cantilever hinge, urging said shorting element into said first position; and wherein during unmating said detent is counter rotated out from under said cantilever hinge, allowing said cantilever hinge to relax and moving said shorting element into said second position.

34. A hazard detector comprising:

at least two separable portions, one of which includes electrical circuitry and a source of power;

an electrical interrupt within said electrical circuitry that provides at lest one single-point break therein; and a movable shorting element alternately actuatable between a first position closing said break, and a second position opening said break, respectively, said shorting element being actuatable in tandem with a mating and unmating of said two separable portions, wherein said shorting element is actuatable into said first position while said two separable portions are mated, and actuatable into said second position only while said two separable portions are unmated;

said movable shorting element being disposed on a spring loaded shaft which is housed in a capsule; and said spring loaded shaft being actuatable in direction substantially orthogonal to a plane defined by said two separable portions and substantially parallel to a mating direction of said two separable portions.

35. A hazard detector comprising:

at least two separable portions, a first separable portion and a second separable portion, said first separable portion including electrical circuitry and a source of power;

an electrical interrupt within said electrical circuitry that provides at lest one single-point break therein; and said electrical interrupt including a pair of set apart pins extending in a direction substantially orthogonal to a plane defined by said separable portions;

a shorting element disposed in said second separable portion, said shorting element including a substantially planar contact strip; and wherein a mating of said separable portions includes rotating them into a first position relative to one another; said pair of set apart pins being rotated into electrical contact with said shorting element thereby electrically closing said electrical interrupt; and wherein an unmating of said separable portions includes counter rotating them into a second position relative to one another, at least one of said pair of set apart pins being counter rotated out of electrical contact with said shorting element thereby electrically opening said electrical interrupt.

* * * * *